US007013610B2

(12) United States Patent
Kunz

(10) Patent No.: US 7,013,610 B2
(45) Date of Patent: Mar. 21, 2006

(54) DRYWALL CORNERBEAD WITH PAPER LEGS

(75) Inventor: Roland Kunz, Omaha, NE (US)

(73) Assignee: Phillips Manufacturing Co.,, Omaha, NE (US)

( * ) Notice: Subject to any disclaimer, the term of this patent is extended or adjusted under 35 U.S.C. 154(b) by 372 days.

(21) Appl. No.: 10/324,922

(22) Filed: Dec. 20, 2002

(65) Prior Publication Data

US 2003/0131546 A1 Jul. 17, 2003

Related U.S. Application Data

(60) Provisional application No. 60/349,890, filed on Jan. 17, 2002.

(51) Int. Cl.
*E04B 1/00* (2006.01)

(52) U.S. Cl. ..... 52/255; 52/256

(58) Field of Classification Search ..... 248/254–257, 248/287.1

See application file for complete search history.

(56) References Cited

U.S. PATENT DOCUMENTS 1,608,475 A * 11/1926 Dean ..... 52/255
5,045,374 A * 9/1991 Tucker ..... 428/83
6,073,406 A 6/2000 Kearney
6,295,776 B1 * 10/2001 Kunz et al. ..... 52/255
6,539,680 B1 * 4/2003 Kunz et al. ..... 52/256
6,571,520 B1 * 6/2003 Koenig et al. ..... 52/287.1

* cited by examiner

*Primary Examiner*—Korie Chan

(57) ABSTRACT

The corner bead of the present invention includes an elongated strip of metal material with a central arcuate nose and a pair of flanges extending outwardly from the nose. A paper strip is bonded only to the outward faces of each of the flanges, with a wing portion extending beyond the outer edge of each flange. Each paper strip begins proximal to, but does not cover the nose, such that the nose is exposed after installation of the corner bead on a wallboard corner. The paper strips are applied only to the outward face of each flange. In the method of the invention, a tape-on corner bead is provided with paper strips bonded only to the outer face of the flanges of the core strip, with portions of the strips overhanging the outer edges of the flanges to form wings. A layer of joint compound is applied to a wallboard corner, and the corner bead is applied, with the inward faces of the flanges and the wings in direct contact with the joint compound. A finish layer of joint compound is then applied over the outward face of the paper strips, extending from the nose of the corner bead and feathered onto the wallboard, leaving the nose of the corner bead exposed.

3 Claims, 2 Drawing Sheets

DRYWALL CORNERBEAD WITH PAPER LEGS

CROSS-REFERENCES TO RELATED APPLICATIONS

Priority is claimed based upon Provisional Application Ser. No. 60/349,890, entitled "Drywall Corner bead with Paper Legs", filed Jan. 17, 2002.

STATEMENT AS TO RIGHTS TO INVENTIONS MADE UNDER FEDERALLY SPONSORED RESEARCH AND DEVELOPMENT (Not applicable)

BACKGROUND OF THE INVENTION (1) Field of the Invention

The present invention relates generally to drywall construction, and more particularly to an improved metal corner bead with paper legs.

(2) Background Information

Current building construction utilizes sheets of drywall, commonly referred to as "wallboard," to form the surfaces of interior walls of buildings. Drywall is typically formed of sheets of plaster sheathed in an outer wrapping of heavy construction paper.

In drywall construction, joints between adjacent sheets of drywall are usually covered by a paper tape extending lengthwise along the joint. To finish exterior corners in wallboard construction, metal corner beads and bullnose beads are typically installed. Similarly, metal trim is used to protect and finish a wallboard edge at window and door jams, while expansion joints are inserted between sheets of wallboard at predetermined intervals within buildings.

The above-described corner bead and trim products include metal flanges projecting outwardly, which are perforated with circular holes or elongated slots, so that the trim product may be fastened to the drywall panels using nails or the like. Wet plaster is then smoothed into place to cover the metal flanges, and edges of the plaster are smoothed and feathered to cover and conceal the metal edges.

Another type of corner bead is referred to as a "tape-on" bead. Tape-on corner beads utilize a strip of paper covering the exterior surface of the metal corner angle, with wings projecting outwardly from the legs of the corner angle. Wet plaster or joint cement secures these paper wings to the drywall, to secure the corner bead in position, rather than using nails or other fasteners. However, one problem associated with such "paper bead" is the scuffing and damage to the paper covering the curved nose of the bead once the bead has been installed on a corner. Because the curved nose portion of the bead is directly exposed, and has no plaster or other material covering the paper, the paper may be easily scuffed or torn with only minimal contact.

One known attempt to overcome the problems associated with conventional tape-on corner bead is disclosed in U.S. Pat. No. 6,073,406 to Raymond Kearney. This patent discloses a corner bead assembly with offset flanges that are sandwiched between front and rear layers of flexible material. These layers are adhered to each other past the terminal edge of each of the offset flanges and are adhered to each of the offset flanges as well.

While this assembly apparently works sufficiently for its intended purpose, it also suffers drawbacks. The cost to manufacture the product is greater than necessary because of the use of two layers of flexible material, such as paper. Second, this cost is increased by virtue of the fact that the front and rear layers must be accurately positioned in order to provide the desired overlap, so that the layers can be adhered to each other (in yet an additional manufacturing step) in the area where they protrude beyond the terminal edges of the flanges. Thus, cost of material is high, and time required for manufacturing is high.

The corner bead of the present invention overcomes these drawbacks by the application of paper only to the forward faces of the legs of the metal angle.

BRIEF SUMMARY OF THE INVENTION

It is therefore a general object of the present invention to provide an improved corner bead with paper legs on the flange forward faces for attaching the bead to a structure.

These and other objects will be apparent to those skilled in the art.

The corner bead of the present invention includes an elongated strip of metal material with a central arcuate nose and a pair of flanges extending outwardly from the nose. A paper strip is bonded only to the outward faces of each of the flanges, with a wing portion extending beyond the outer edge of each flange. Each paper strip begins proximal to, but-does not cover the nose, such that the nose is exposed after installation of the corner bead on a wallboard corner. The paper strips are applied only to the outward face of each flange. In the method of the invention, a tape-on corner bead is provided with paper strips bonded only to the outer face of the flanges of the core strip, with portions of the strips overhanging the outer edges of the flanges to form wings. A layer of joint compound is applied to a wallboard corner, and the corner bead is applied, with the inward faces of the flanges and the wings in direct contact with the joint compound. A finish layer of joint compound is then applied over the outward face of the paper strips, extending from the nose of the corner bead and feathered onto the wallboard, leaving the nose of the corner bead exposed.

BRIEF DESCRIPTION OF THE SEVERAL VIEWS OF THE DRAWING

The preferred embodiment of the invention is illustrated in the accompanying drawings, in which similar or corresponding parts are identified with the same reference numeral throughout the several views, and in which.

DETAILED DESCRIPTION OF THE INVENTION

Figure 1:
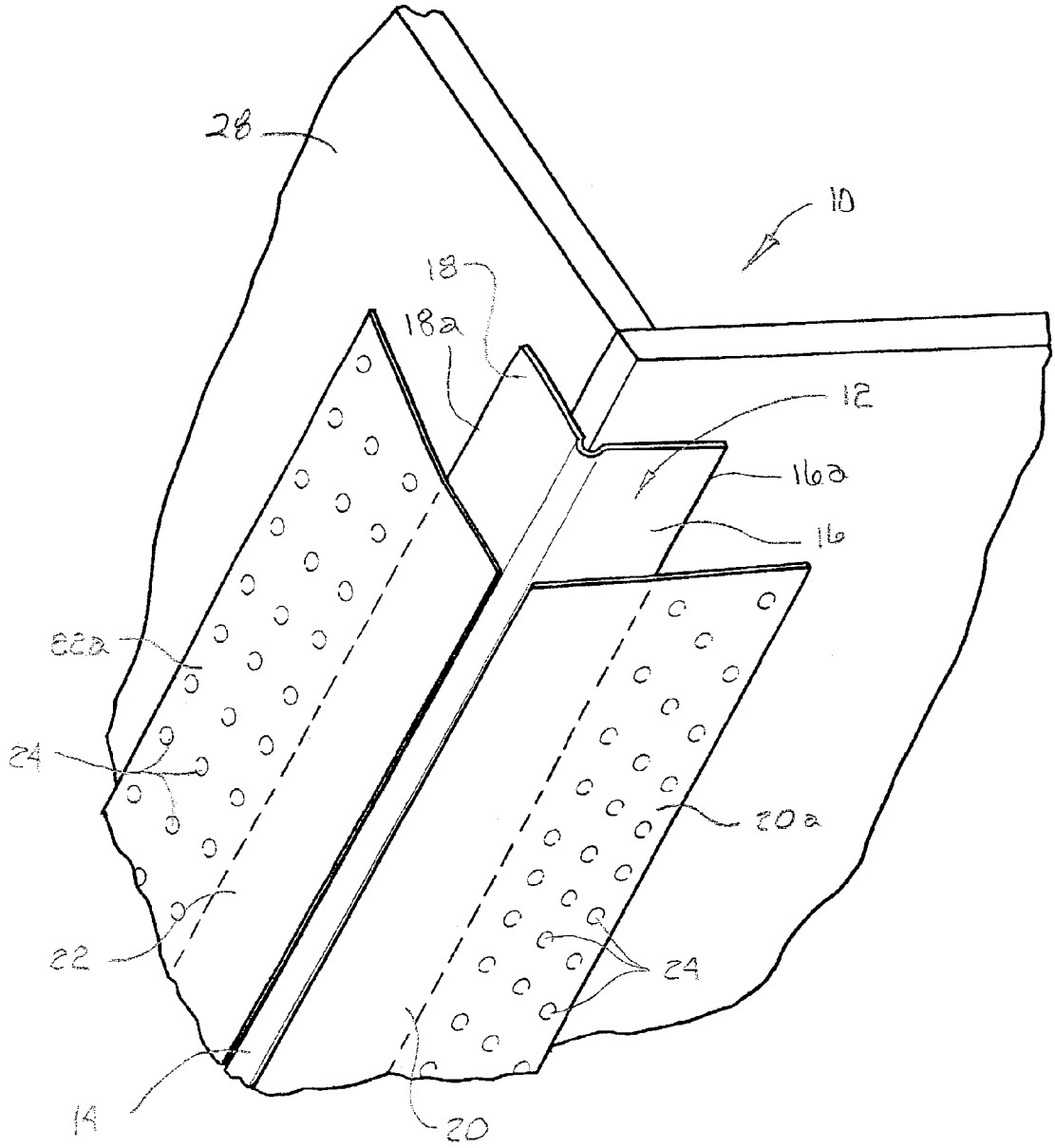
FIG. 1 is a perspective view of a corner bead of the present invention.

Referring now to the drawings, in which similar or corresponding parts are identified with the same reference numeral, and more particularly to FIG. 1, the corner bead with paper legs of the present invention is designated generally at 10 and includes an elongated metal core strip 12 with a central arcuate longitudinal channel forming a nose 14, and with flanges 16 and 18 extending outwardly from each edge of the channel of nose 14 to longitudinal edges 16*a* and 18*a*, respectively.

Core strip 12 is preferably a galvanized steel strip having a thickness of approximately 0.014 inches, which has bee roll-formed. In the preferred embodiment, the flanges 16 and 18 are ¾ inch in length, measured from the edge of nose 14. The typical cores strip nose will have an outside radius of up to about 1.5 inches, and project outwardly from the plane of the flanges approximately 0.033 inches, to provide space to receive joint compound, to cover and dress the corner.

An elongated paper strip 20 is bonded to the outside face of flange 16 and extends outwardly from the edge of nose 14 beyond the distal edge 16*a* of flange 16. This projecting portion of paper strip 20 will be referred to as "wing" 20*a*.

A second paper strip 22 is mounted to the bonded face of flange 18 and extends outwardly from the edge of nose 14 beyond the distal edge 18*a* of flange 18 to form wing 22*a*. Paper strips 20 and 22 preferably extend the entire length of core strip 12, with uniformly projecting wings 20*a* and 22*a*.

Paper strips 20 and 22 may be conditioned by abrading the surface of the paper fibers, to assist in the adhesion of the paper strips with the joint compound. In addition, wings 20*a* and 22*a* may be perforated and/or provided with rearwardly projecting dimples 24. Perforations assist in adhering the paper with the joint compound, as do the depressions formed by dimples 24.

The paper strips preferably have a thickness of about 0.007 inches and will project beyond flanges edges 16*a* and 18*a* approximately ⅝ of an inch. The dimples are formed by pressing an indented profile into the paper in such a way that some of the paper fibers are burst to create a rough, fibrous opening, yet leave enough embossed edges to provide a standoff profile. Each dimple is embossed to an initial height of approximately 0.007 inches to 0.014 inches. Dimples 24 may be round, square, oblong, or of any other similar shape.

It can be seen that dimples 24 assist in providing a uniform distribution of joint compound between the wings 20*a* and 22*a* and the wallboard 28 to which corner bead 10 is attached. During installation, a layer of joint compound or "mud" is applied to the wallboard under wings 20*a* and 22*a* to adhere the wings to the wallboard 28. Dimples 24 act as standoffs, providing a uniform depth of mud along the entire length of wings 20*a* and 22*a*, as well as providing anchorage into the joint compound. This in turn prevents over application of mud and improves the overall results. An additional layer of mud is then applied in a conventional manner to cover the entire paper strip 20 and 22 from nose 14 outwardly over wings 20*a* and 22*a*.

Paper with an off-white tint is preferred, so as to match the color of the drywall facing paper and joint cement. In this way, if a portion of the joint compound is sanded away to reveal the paper strips, the color of the paper strips will closely match the color of the wallboard, and will not reveal any stark contrasts.

Corner bead 10 is applied in a conventional manner for tape-on beads. In this way, the nose 14 is left exposed, without a paper covering which could be scuffed or torn.

Figure 2:
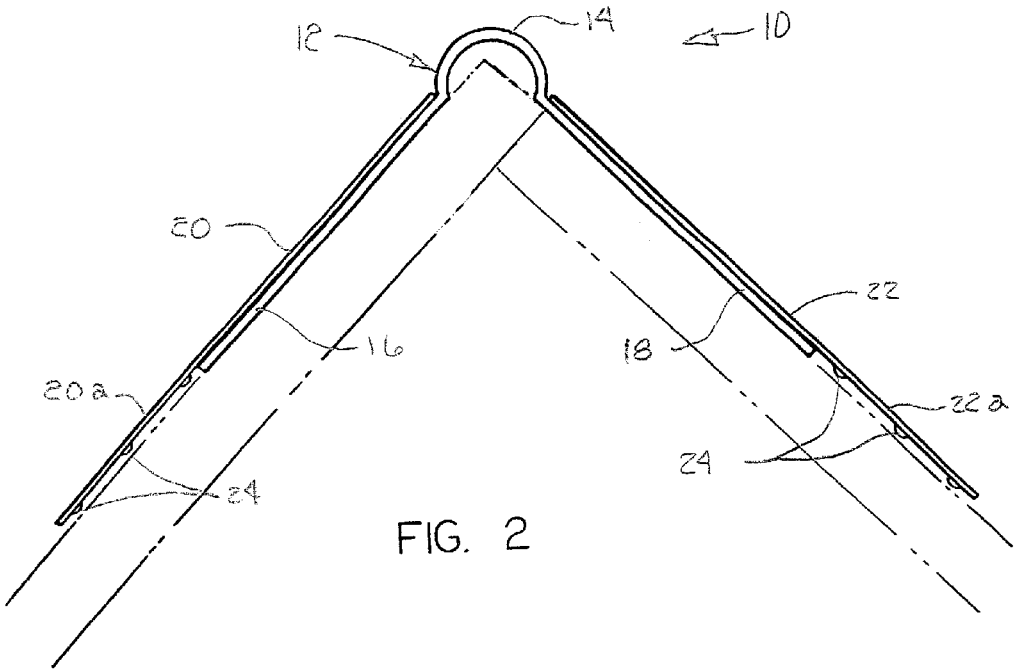
FIG. 2 is an end view of the corner bead, with a corner shown in broken lines.
Figure 3:
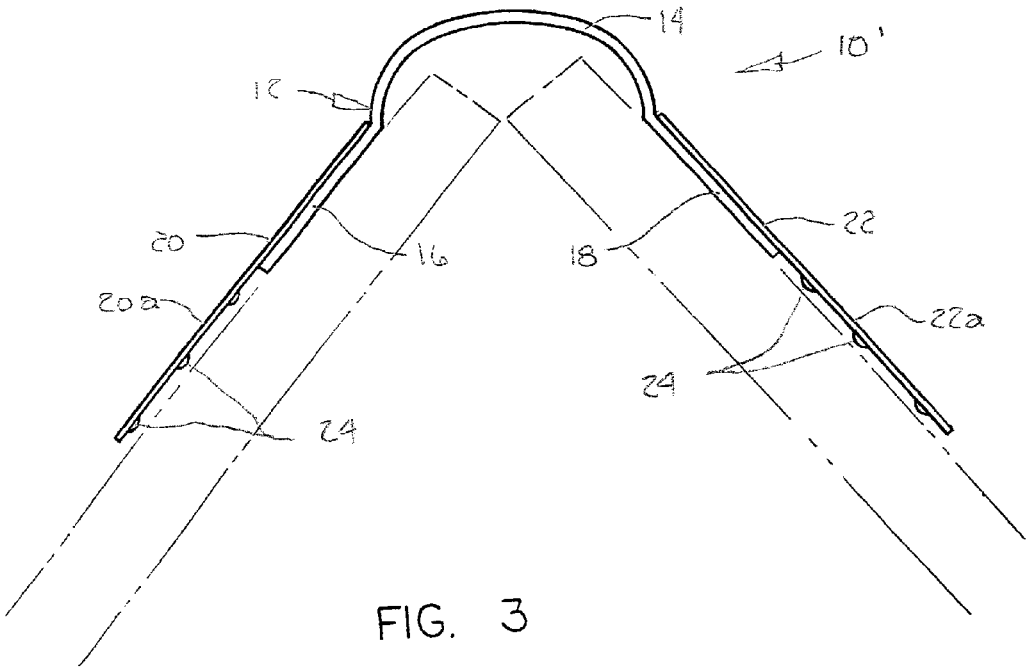
FIG. 3 is an end view of a bullnose bead of the present invention.

Referring now to FIG. 3, a bullnose corner bead is designated generally at 10', and includes all of the same elements as the corner bead 10 of FIGS. 1 and 2. Thus, bullnose 10' includes a metal core strip 12 with a nose 14 and flanges 16 and 18. Paper strips 20 and 22 extend from the nose outwardly beyond the edges of flanges 16 and 18 respectively, to form wings 20*a* and 22*a*. The only difference between bullnose 10' and corner bead 10 is the shape and extent of the nose 14, which is exposed without paper strips 20 and 22 covering the nose 14.

Whereas the invention has been shown and described in connection with the preferred embodiments thereof, many modifications, substitutions and additions may be made which are within the intended broad scope of the appended claims. More specifically, this invention may be applied to all varieties of drywall accessory or trim, including those types described in ASTM C 1047-99.

What is claimed is:

1. A tape-on drywall accessory for drywall construction, comprising:

an elongated core strip having inward and outward faces, having a longitudinal arcuate channel forming a nose portion extending from end to end, and a first flange projecting transversely outwardly from the nose portion to an edge;

a first elongated paper strip affixed to an outward face of the first flange and extending from end to end, with a portion extending transversely beyond the edge of the first flange to form a wing;

said paper strip affixed to the core strip with an edge proximal, but not covering, the nose.

2. The tape-on drywall accessory of claim 1, further comprising:

a second flange projecting transversely outwardly from the nose, generally diametric to the first flange;

a second elongated paper strip affixed to an outward face of the second flange and extending from end to end, with a portion extending transversely beyond the edge of the second flange to form a wing;

said second paper strip affixed to the second flange with an edge proximal, but not covering, the nose.

3. The tape-on drywall accessory of claim 1, wherein core strip is metal.

* * * * *